United States Patent [19]

Foster

[11] 3,947,232

[45] Mar. 30, 1976

[54] DECORATIVE CANDLE AND METHOD OF MANUFACTURE THEREFOR

[76] Inventor: Donald Foster, 215 Wells St., Peekskill, N.Y. 10566

[22] Filed: July 18, 1974

[21] Appl. No.: 489,507

[52] U.S. Cl. ..... 431/288; 264/299; 264/275; 425/803

[51] Int. Cl.[2] ..... C11C 5/00

[58] Field of Search ..... 431/288, 126; 264/299, 264/330, 275; 425/803

[56] References Cited

UNITED STATES PATENTS

| | | | |
|---|---|---|---|
| 2,122,451 | 7/1938 | Cassimatis | 425/803 |
| 2,315,751 | 4/1943 | Webber | 431/288 |
| 2,974,509 | 3/1961 | Penke | 431/288 |
| 3,254,512 | 6/1966 | Prentice | 431/288 |
| 3,283,546 | 11/1966 | Matsui | 431/288 |
| 3,385,649 | 5/1968 | Hicks | 431/126 |
| 3,744,956 | 7/1973 | Hess | 431/126 |

*Primary Examiner*—Carroll B. Dority, Jr.
*Attorney, Agent, or Firm*—Martin J. Spellman, Jr.

[57] ABSTRACT

A decorative candle molded from candle material wherein the surface of the candle has a plurality of randomly distributed pores adjacent the surface thereof only and said pores are less than 4 millimeters diameter in size and form an attractive random pattern. There are at least 5 said pores per said centimeter of the surface of said candle and the central portion of the candle is substantially pore-free.

The candle is made by melting candle material and then cooling the liquid candle material to a temperature and for a time such that a thin film is formed on the surface of the liquid candle material, then mixing the liquid and film phases until the mixture is bubbly and thereafter pouring the candle material into a candle mold from a height at least 50% greater than the height of the mold, cooling and removing the candle from the mold.

4 Claims, 4 Drawing Figures

DECORATIVE CANDLE AND METHOD OF MANUFACTURE THEREFOR

BACKGROUND OF THE INVENTION

1. Field of the Invention

This invention relates to candles and more particularly to large size decorative candles having interesting surface decorations thereon and to a method for manufacturing such candles. While the method of manufacture of the present invention is of particular advantage in the manufacture of large candles, it is equally applicable in manufacturing candles of varying sizes; however, because of the large surface area of bigger candles, it is particularly well suited for obtaining very pleasing as well as interesting decorative finishes. The candle of the present invention is one without any significant voids except in the region of the external surfaces and immediately adjacent to external surfaces. This presents a very pleasing and interesting decorative appearance hitherto not obtained in the decorative candle arts.

2. Prior Art:

The decorative candle of the present invention has a substantially solid body except that the surface region has a unique and attractive effect described in greater detail below. Various attempts have been made in the art to obtain economical and interesting effects particularly in the case of large candles.

In U.S. Pat. No. 3,254,512 Prentice, a candle of large dimension and relatively low density is disclosed which presents a porous external appearance but is in fact porous throughout the candle with the pores or voids being of relatively large dimension. In this case, the effect is produced by pouring melted wax into a large candle mold, the mold previously having been filled with crushed ice. The size of the crushed ice particles ranges from those passing a ½ inch screen mesh to a 1 inch screen mesh. The wax when it is poured is at or above the melting point of the wax. The molten wax contacting the crushed ice is rapidly chilled and this accelerates the setting of the candle and at the same time, the hot wax coming in contact with the ice is melted quite rapidly. The resulting candle has many irregular large shaped openings connecting its exterior surface with a series of voids which extend throughout the body of the candle. The voids are formed as the crushed ice subsequently melts and the water runs out of the candle. This structure results in a candle of large dimensions but relatively low density and containing significantly less paraffin or other candle material to burn than other candles. As it burns, the voids with the light shining through the thin partitions of the voids illuminate the upper portion of the candle with a soft radiance. There is a tendency for the melted wax to flow out through the voids descending copiously down the sides of the candle. Thus while such a candle presents a novel structure, it has a deficit in the amount of paraffin available to burn and is of relatively short duration for its size. It has a tendency to cause a messy accumulation of paraffin due to the running of the molten paraffin from the interior through the voids and down the side of the candle.

In U.S. Pat. No. 2,974,502, there is disclosed a decorative candle which is the form of a flower and constructed with a special base and core. The candle in this case is comprises of paraffin which has been whipped to the consistency of whipped cream, distributing minute air bubbles in the paraffin so that in effect it is foamed. This tends to give the paraffin when it is cooled a translucent characteristic. The paraffin is whipped after having been melted and cooled down to a point where a thin film or skimming appears on the top surface of the molten paraffin. It is whipped using a beater and thereafter when in a more or less plastic state is molded to the desired shape with various sculpturing tools as the case may be.

SUMMARY OF THE INVENTION

The present invention is concerned with a decorative candle having a very interesting aesthetically pleasing surface effect resulting from the presence of a multitude of pores on the surface of the candle and extending into the body of the candle a very limited depth, not over 5 millimeters. The pores range in size from micropores hardly visible (200 microns) to the naked eye to approximately 4 millimeters in diameter. The majority being less than 1 millimeter across and the voids extending less than 5 millimeters into the body of the candle. The candle, therefore, is one having a body, the central portion of which is void free and one having a very interesting surface effect which is consistently obtained. The overall appearance is one of a unique irregular porous structure which is wholly random. The effect is enhanced in the case of dyed candles wherein the variations of shade add interest to the surface.

The invention further comprises a method of making this candle. The method employs no special mold or mold fillers such as the crushed ice above nor are any time-consuming and complicated molding techniques required.

The process of obtaining the decorative candle of the present invention comprises utilizing paraffin or its equivalent candle material which commonly has a melting point ranging from 133° to 145°F. A conventional mold for a large candle is prepared in the usual manner. Paraffin is melted in a melting container. The melted paraffin is allowed to cool down to the point where a thin film is formed on the top surface of the melted paraffin in the container. When this occurs, the wax has usually reached the temperature of approximately 100°F. It has been found that the film should be thick enough to be able to form a definite break in it. A pouring ladle or a pouring can may be used to mix up the paraffin when it has reached this state. The paraffin is agitated to the state where it has a bubbly appearance but it is stirred or mixed rather than having air whipped into it. A quantity of paraffin sufficient to fill the mold, and preferably 50% excess, is placed in a pouring ladle and from the pouring ladle poured into the prepared mold from a height at least 50% higher than the height of the mold. In the case of a 12 inch candle, for example, I have found that initial pouring should be at least 6 inch from the top of the mold. The pouring should be at a steady rate in order to insure a relatively even effect in the final decorative candle.

After pouring into the mold, the candle paraffin was allowed to cool to room temperature in the mold. The candle is then treated according to the usual procedures, by punching holes in the bottom of the mold after about 45 minutes to relieve wick tension and subsequently filling any well which forms with molten paraffin. The candle in the mold is placed in a refrigerated atmosphere for approximately 1 hour and finally removed from the mold and trimmed to standard height as required. While the mechanism is not understood, the resulting candle when sectioned, except for the surface effect, is substantially void free throughout. The surface presented is one of random pores opening into the surface with the pores of sizes varying from micropores to just under 4 millimeters scattered in a random distribution over the surface thereby presenting a very unique and interesting appearance, adding greatly to the marketable value of the candle.

BRIEF DESCRIPTION OF THE DRAWINGS

Other objects and advantages of the present invention may be more clearly seen when viewed in conjunction with the accompanying drawing wherein.

SPECIFIC EMBODIMENTS

Figure 1:
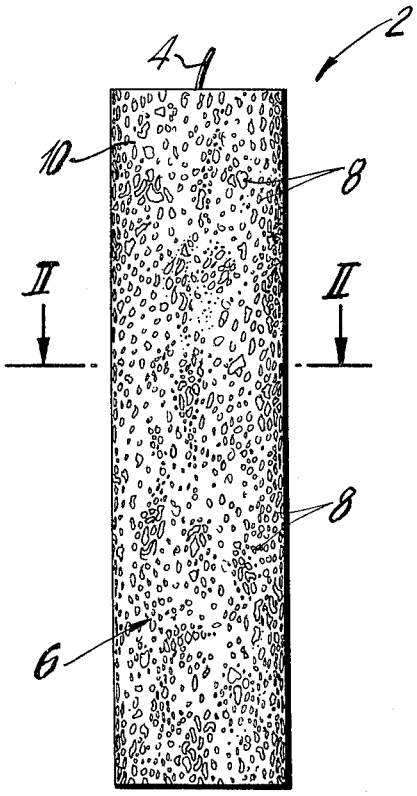
FIG. 1 is a plan view of a candle according to the present invention illustrating the surface effects obtained according to the invention.
Figure 3:
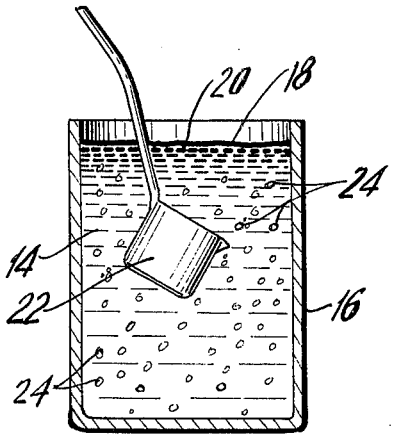
FIG. 3 is a view in section of a container of stirred melted paraffin wax.

A candle made according to the method of the present invention is illustrated in the accompanying drawing. Referring to FIG. 1, the candle 2 with wick 4 is shown with the random pattern 6 of voids 8 of varying sizes indicated schematically. As mentioned, the voids range in diameter from microscopic to about 4 millimeters and a randomly distributed on and adjacent the surface 10 of the candle 2.

Figure 2:
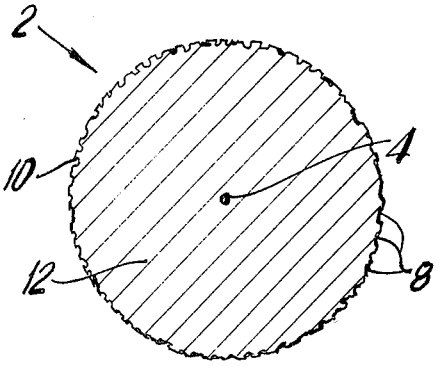
FIG. 2 is a section through the candle along lines II—II of FIG. 1.

The sectional view of the candle 2 is shown in FIG. 2 and it is seen that voids 8 are only present at and immediately adjacent the surface 10 of the candle 2, extending approximately 5 mil. into the candle 2. The entire central portion 12 of the candle 2 is void free.

The candle 2 shown in FIGS. 1 and 2 is made as follows:

Paraffin 14 having a melting point of about 137°F is melted in a container 16, and then allowed to cool to below 100°F and stand until a thin film 18 is formed on surface 20 of the paraffin. A pouring ladle 22 is then placed in the paraffin 14 and the paraffin stirred to a point where it takes on a somewhat bubbly appearance indicated by bubbles 24.

Figure 4:
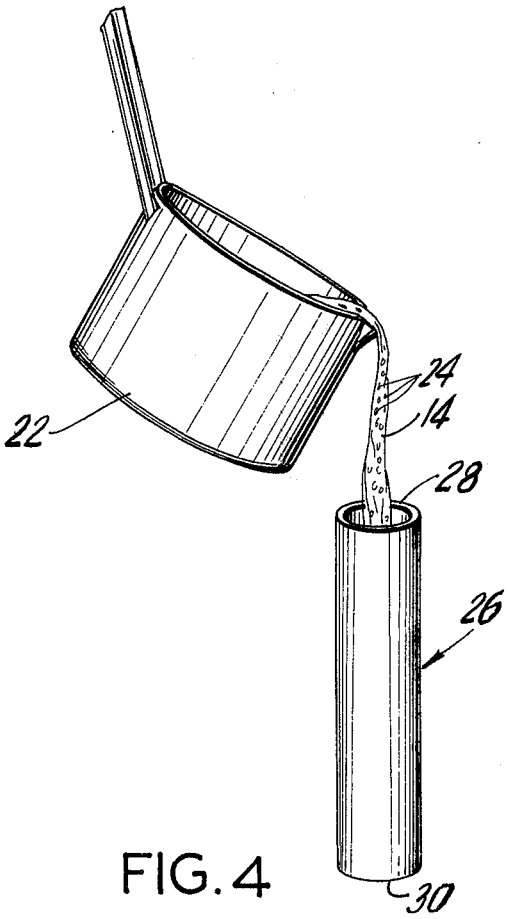
FIG. 4 is a perspective view illustrating filling a candle mold according to the present invention.

Previously a standard candle mold 26 for a candle 3 inch in diameter and 12 inch in height has been prepared. The pouring ladle 22 which holds approximately twice the volume of paraffin necessary to fill the mold 26 is dipped into the bubbly paraffin 14 in the container 16 and thereafter as shown in FIG. 4 poured from a height of about 6 inch above the top 28 of the mold into the mold 26. The pouring is at a steady rate so that the resulting surface effect is what is termed a consistently random effect. The candle is allowed to dry routinely at room temperature in the mold 26 and then holes are punctured into the bottom 30 of the mold to relieve the tension of the wick 4. After 45 minutes, the well formed in the bottom of the candle is filled with heated paraffin at 250°F. After the mold 26 and candle 2 are again cooled, they are placed in a refrigerator or similar cooling compartment for about 1 hour and then the candle 2 is removed from the mold 26 and trimmed to desired size. The decorative surface is unique and very attractive making candles with it highly valued for both their decorative and utilitarian properties.

While the invention has been explained by a detailed description of certain specific embodiments, it is understood that various modifications and substitutions can be made in any of then within the scope of the appended claims which are intended also to include equivalents of such embodiments.

What is claimed is:

1. A process for making a decorative candle of generally cylindrical shape comprising melting candle material at or above its melting point to a liquid phase cooling said liquid candle material to a temperature and for a time such that a film is formed on the surface of said liquid candle material, gently mixing the liquid and film phases of said candle material and thereafter pouring said mixed candle material into a cylindrical candle mold from a height of at least 50% greater than the height of the mold, cooling to a solid phase, and removing the resulting candle from said mold.

2. A process as claimed in claim 1 wherein said candle material is a paraffin wax melting at a temperature from 133° to 142°F and wherein following the melting step said paraffin is cooled to a temperature of 100°F.

3. A decorative candle made according to the process of claim 1.

4. A decorative candle made according to the process of claim 2.

* * * * *